US005684463A

United States Patent [19]

Diercks et al.

[11] Patent Number: 5,684,463

[45] Date of Patent: Nov. 4, 1997

[54] ELECTRONIC REFRIGERATION AND AIR CONDITIONER MONITOR AND ALARM

[76] Inventors: Richard Lee Roi Diercks, 906 25th Ave., Council Bluffs, Iowa 51501; Robert Lee Parrott, 305 Elliott St., Council Bluffs, Iowa 51503

[21] Appl. No.: 587,003

[22] Filed: Jan. 16, 1996

Related U.S. Application Data

[63] Continuation-in-part of Ser. No. 247,287, May 23, 1994, abandoned.

[51] Int. Cl.[6] ..... G08B 21/00

[52] U.S. Cl. ..... 340/584; 340/585; 340/588; 340/596

[58] Field of Search ..... 340/585, 588, 340/584, 596

[56] References Cited

U.S. PATENT DOCUMENTS

| | | | |
|---|---|---|---|
| 2,994,858 | 8/1961 | Coffer | 340/585 |
| 3,753,259 | 8/1973 | Donovan | 340/585 |
| 4,024,495 | 5/1977 | O'Brien | 340/585 |
| 4,384,282 | 5/1983 | Dennison, Jr. | 340/585 |
| 4,882,564 | 11/1989 | Monroe et al. | 340/585 |
| 5,262,758 | 11/1993 | Nam et al. | 340/585 |

OTHER PUBLICATIONS

Technical Submission/KOOLGuard/May 23, 1994.

*Primary Examiner*—Glen Swann
*Attorney, Agent, or Firm*—Michael I. Kroll

[57] ABSTRACT

An electronic refrigeration and air conditioner monitor and alarm system monitors air conditioning and refrigeration systems for inefficiencies that waste energy. The device monitors and analyzes the temperatures of the suction line of such systems for variances that indicate malfunctions or abnormal operation of the system. The device provides both an audible and visual alert to warn the end user that the equipment is in need of maintenance and/or repair.

9 Claims, 5 Drawing Sheets

ELECTRONIC REFRIGERATION AND AIR CONDITIONER MONITOR AND ALARM

This is a Continuation-In-Part of application Ser. No. 08/247,287 filed May 23, 1994 now abandoned.

BACKGROUND OF THE INVENTION

1. Field of the Invention

The present invention relates to an electronic refrigeration and air conditioner monitor and alarm system for use in monitoring and analyzing the temperature of an air conditioning or refrigeration system's suction line for variances that indicate malfunctions or abnormal operation of the system, and wherein the system further provides an alarm in those instances in which the system is operating outside the preferred temperature range, thus indicating inefficient or abnormal operation of the air-conditioning or refrigeration system.

2. Description of the Background Art

Agencies or associations like the Air-Conditioning & Refrigeration Institute (ARI) and the American Society of Heating, Refrigeration, and Air-Conditioning Engineers (ASHRAE) set the standards that drive the air conditioning and refrigeration industry. All technical references and studies used to illustrate and document the principles presented herein are made with reference to established standards published by the ARI in their book titled "Refrigeration and Air-Conditioning", 2nd edition, copyrighted 1987, 1979 by Prentice-Hall, Inc., which is hereby incorporated by reference.

In its most basic form, all Air-Conditioning and Refrigeration systems are heat-energy-transfer devices. They are only capable of absorbing heat from a heat source and rejecting that heat into a heat sink. Air-Conditioning systems absorb heat from within a structure via the evaporator coil and reject that heat outside into a condensing coil. The rate at which it does this is dependent on the amount of heat available and the rate of transfer. The rate of transfer will depend on maintaining the proper temperature difference between the refrigerant and the material from which the heat is to be extracted or to which the heat is to be rejected. As the second law of Thermodynamics states "to cause heat energy to travel, a temperature difference must be established and maintained."

With regards to the heat source (evaporator coil), is there a sufficient heat source to satisfy the capacity of the system? If a system is capable of extracting 24,000 BTU/hr (2 ton air-conditioning unit) with a 20 degrees F. temperature difference (TD), this amount of heat must be available. If air is the means of carrying the heat from the product to be cooled to the evaporator for extraction, the correct amount of air must pass through the coil. If insufficient air is being supplied because of a dirty filter (the most common air flow problem), slow pumping fan or blower, dirty coil fins or any other reason for reduction in the air quantity, the amount of heat absorbed is reduced. With the absorbed heat reduced, the coil operates at a lower temperature, the refrigerant boiling point is lower, and system capacity is lost. This also applies if the heat is transferred by means of a liquid. A reduction in the quantity of the liquid through the heat exchanger reduces heat absorbed, lowers the coil boiling point, and lowers suction pressure and system capacity.

With regards to the heat sink, problems are usually easier to diagnose because the change in the system becomes more radical with a change in operating conditions of the heat sink. When the air through the air cooled condenser is reduced, head pressures and compressor amperage draw go up and system capacity drops. When the liquid through the liquid condenser is reduced, head pressures rise together with amperage draw of the compressor and reduction in capacity results. The effect on capacity is not as great, however, as a change in load on the evaporator, so problems usually exist and grow until a radical departure from normal occurs. Up to this point, air-conditioning has been discussed as the process of removing heat picked up from the evaporator and dissipating that heat into the outside air via the condensing coil. The concepts described below are fundamental to all air-conditioning equipment.

Whenever an air-conditioning system is called upon for cooling, three or four things happen simultaneously:

First the compressor is energized and begins operation, pumping vaporized refrigerant out of the evaporator, compressing it and sending it to the condenser. This immediately creates a difference in pressure between the high and low sides of the system.

The condenser fan is energized and begins blowing outside air across the condenser coils so that the heat within the refrigerant vapor will be dissipated to the outside air.

A metering device, whether it be an expansion valve (TEV) or a capillary tube, will begin passing liquid refrigerant into the evaporator so that it can begin to pick up heat from the airstream around the evaporator.

If the system is not on continuous blower operation, the evaporator blower will come on. The blower will funnel the warm air from the space to be cooled across the surface of the evaporator coil so that the heat contained in the air can be picked up by the refrigerant passing through the evaporator coil.

Some systems will have better or poorer operating efficiencies. It should also be noted that the operating temperatures and pressures will change in a system depending on the heat load presented to the evaporator.

Under theoretical conditions, the refrigerant entering at the metering device is in a liquid form at a 114 degrees F. temperature (having been subcooled 16 degrees F. after leaving the condenser), approximately 299 psig, and has a heat content or enthalpy of 45 BTU's. The liquid refrigerant passes through the metering device, be it an expansion valve (TEV) or capillary tube, into the low side of the system, and immediately expands and cools part of the refrigerant. As the liquid passes through the evaporator coil, it picks up heat from the airstream around it and begins changing to a vapor. At the exit of the evaporator, the vapor has a temperature of approximately 45° F. and a pressure of about 77 psig. Before entering the compressor, it is superheated 10° F. to 55° F., but the pressure remains constant at 77 psig. Its enthalpy or heat content, however, will have increased to 100 BTU's, having picked up 64 BTU's of latent heat from the room air and one BTU of sensible heat due to superheat.

The vapor is then pumped into the compressor shell where it passes over the motor and picks up additional heat from the motor, amounting to approximately 24 more BTU's, giving the vapor a total additional heat content of 89 BTU's. As it passes into the compressor cylinder, the vapor is compressed. At this time, its temperature will be raised to about 230° F. and the pressure, during the short time that it is in the compressor cylinder, will be raised considerably. Its heat content, or enthalpy, after the heat of compression, will amount to about 134 BTU's.

The vapor passes from the compressor discharge port through the discharge line and into the top row of the condenser. At this point, its temperature is 130° F., it is at about 299 psig and after the first one or two rows in the condenser, will lose about 20 BTU's, so its heat content will be 144 BTU's per pound.

As it passes through the remaining rows in the condenser, the vapor loses more heat to the outside air and changes state from a gas back into a liquid. As it gets to the bottom row of the condenser, all of the refrigerant will have changed to a liquid. It will be at 130° F. and 299 psig, with a heat content or enthalpy of 51 BTU's. The loss of 83 BTU's to the outside air is all latent heat due to its change of state from a gas to a liquid.

Upon leaving the condenser, the liquid is subcooled, thus eliminating another 6 BTU's. So, as it approaches the metering device for another circuit through the system, the liquid will be back to its original conditions: 114° F. temperature, 299 psig, with a heat content of 45 BTU's.

The following paragraphs will analyze the problems associated with Air Conditioning and explore how those problems affect a system's performance and operating cost.

The following paragraphs limit the discussion to those problems and solutions that apply to Air-Conditioning systems. Problems in Air-Conditioning systems are classified in only two categories: Air and the Refrigerant circuit. The only problem with air is the reduction in quantity which is common with matted inside air filters, blower or fan motor problems, etc. Problems in the refrigerant circuit can be further broken down into two categories: (1) refrigerant quantity, and (2) refrigerant flow rate. Any problem in either category will affect the temperatures and pressures that will occur in the unit when the correct amount of air is supplied over the DX coil for the capacity of the unit.

The use of the word "normal" does not imply a fixed set of pressures and temperatures. These will vary with each make and model of the system. There are a few temperatures that are fairly consistent throughout the industry that can be used for comparison and must be modified according to the EER rating of the unit. These are (1) DX coil operating temperatures, (2) condensing unit condensing temperatures, and (3) refrigerant subcooling.

With reference to a capillary tube system, the system charge or refrigerant level is extremely critical and must be maintained within a −5% tolerance to be properly maintained. Capillary tube systems represent the majority of residential Air-Conditioning systems (approximately 90%) as well as a growing number of the commercial and industrial applications. This is largely due to the cost reduction and lower compressor starting-torque requirements associated with a capillary tube design. Refrigerant charge has a large effect on the performance of Air-Conditioning units. For this example, the effect on the performance of a 2 HP Air-Conditioning unit operating at 90° F. outside ambient and 75° F. inside dry bulb and 63° F. wet bulb at 50% relative humidity (RH) will be explored. This example assumes that the systems of the unit began in proper operating conditions or had been otherwise working correctly.

With the refrigerant charge at 100% of the required amount, the net capacity of the unit was 26,400 BTU/h. When the refrigerant charge was increased 5% (3 oz.), the capacity dropped to 24,600 BTU/h; with an increase of another 5% (3 oz.), the capacity dropped to 19,000 BTU/h. A total overcharge of 9 oz. reduced the capacity to 13,000 BTU/h.

Working the other way from the correct charge, when the quantity was reduced 5% (3 oz.), the net capacity dropped to 25,000 BTU/h, another 5% (2.5 oz.) reduced the capacity to 22,000 BTU/h. A further reduction of 5% (2.5 oz.) reduced the capacity to 18,000 BTU/h. From this it can he concluded that the correct charge results in the best net capacity of the system.

At 100% of charge the kilowatt requirement of the unit to handle the load was 3.195 kW; at 5% overcharge, 3.45 kW; at a 110% overcharge, 3.97 kW; and at 115% overcharge, 4.8 kW. With a reduced charge at 95% undercharge it was 2.97 kW; at 90% undercharge, 2.77 kW; and at 85% undercharge, 2.57 kW.

The true comparison of the system is the operating efficiency, the energy efficiency ratio (EER). This denotes the heat transfer ability of the refrigeration system, expressed in BTU/h, compared to the watts of electrical energy necessary to accomplish the heat transfer. This comparison is expressed in BTU/h/Watt of electrical energy and is determined by dividing the net capacity in BTU/h by watts of electricity needed to produce the capacity.

Now to be given is the EER rating of the example unit at the various refrigerant charge levels. At 100% of refrigerant charge, the EER rating was 8.4 (the optimum rating for this example unit); at 105%, 7.45; at 110%, 5.1; and at 115%, 2.4. With the undercharge at 95% of charge, an 8.2 EER resulted; at 90%, 7.7; and at 85%, 6.75. This points out that with a refrigeration system using capillary tubes, the refrigerant quantity in the system must be accurate. The charge tolerance is plus zero minus 1 ounce. The optimum refrigerant charge levels mentioned above are for the compressor only. The remainder of the refrigerant in a system of a given capacity occupies the evaporator, suction and discharge lines. Also, for the purpose of association, for each 12,000 BTU/hr capacity of a system, the equivalent tonnage is 1 ton. For example, a 2 ton (2 HP) compressor has a capacity of 24,000 BTU/hr.

In most systems some overcharging can be tolerated, but an undercharge is rarely acceptable. Overcharging will create high head pressure and high temperature, with all the resultant problems, such as motor overloading, sludge formation, and compressor valve failure. High head pressures can also result in poor load control, with liquid refrigerant flooding to the compressor. Although the biggest problem with undercharging is that of capacity, it may also create frost conditions on the evaporator in higher temperature refrigeration equipment, and may also cause high evaporator superheats. As some hermetic compressor motors depend on suction gas for cooling, they can be damaged by overheating due to high suction gas temperatures. Both overcharging and undercharging should be avoided, since either condition can do serious harm to or destroy system components. A system undercharge is the most common aspect to be concerned with since it covers 90% or better of the existing systems in operation. This is due to normal system leakage over time, also by problems associated with loose fittings, punctured evaporator or condenser coils, or any other leaks in the systems suction or discharges lines.

Restriction in the outdoor air flow through the condenser coil is typically the result of either a matted or otherwise plugged condenser coil fins or a defective fan motor. In the case of be evaporator coil, restricted air flow is usually resultant from matted air filters, blower motor imbalance, plugged coil fins on the evaporator, or blockage of the return air ducts. At approximately a 30% reduction in air flow, a system's efficiency will drop to about 94% of capacity. And at a 50% reduction in air flow, a system's efficiency will drop to about 86% of capacity.

At approximately a 30% reduction in air flow, a system's capacity will drop to about 96%. And at a 50% reduction in air flow, a system's capacity will drop to about 92% of capacity.

The value and benefits that proper system maintenance has on the performance, life expectancy, and operating cost of any Air Conditioning and Refrigeration system should now be clear.

The following paragraphs will explore the problem of lost efficiency.

Annually, many millions of dollars are spent in the research and development of new, more energy efficient Air Conditioning and Refrigeration equipment as well as new ways to make better use of our natural resources in the production of electrical energy. Home and business owners alike are investing in this new technology with the end result of lowering their annual cooling cost. These investments range from purchases of new, High Efficiency Air Conditioning equipment to making every available modification to structures in an effort to make them more energy efficient (e.g. improving the insulation, weather stripping, programmable thermostats, etc.). Also, many efforts have been made by utility companies and our government to make the consumers of electrical energy better informed on the means and methods available to make better use of our precious resources. This is evident with the mass distribution of brochures or other information detailing the different means and methods currently available to help the consumer to save energy. This is also evident with the introduction of consumer rebates from utility companies on purchases of energy efficient appliances and with the exhaustive testing by manufacturers to assign an efficiency rating to their products (EER ratings).

With the massive utilization and cost of Air Conditioning and Refrigeration technology in most every aspect of our society, it is only common sense that improvements in this area can yield the best returns for the consumers investments in energy efficiency. As the previous section detailed, poor preventive maintenance on Air Conditioning appliances not only has a dramatic effect on the system's performance and operating cost, but on the appliance's life expectancy as well. Just as one can not expect to maintain the optimum mileage on their automobile if the air filters, oil and tires aren't checked or replaced regularly, neither can one expect their new High Efficiency Air Conditioning unit to perform cost effectively with the lack of the same maintenance.

Unfortunately, in the real world, savings from investments in energy efficiency are quickly spent because simple preventive maintenance measures are either being overlooked or forgotten about completely, and equipment malfunctions are left unattended for long periods of time. Even though most Air Conditioning appliances built today can withstand a tremendous amount of punishment and have High Efficiency ratings (EER ratings) of 10 or better, operating costs can, and do, go well above what is expected of the system. At best, small businesses and particularly residential consumers, rely solely on either some sort of loose preventive maintenance schedule to check air filters or an annual system check to assure their equipment is operating efficiently. These measures, though beneficial, often fall far short of what is necessary to keep the consumer's equipment operating efficiently. If most consumers realized that their equipment was costing them too much to operate because of a matted air filter or low refrigerant charge (the most common service related problems), they would obviously take the necessary steps to correct the problem. Usually, the equipment is left to operate and the problem goes unnoticed until it has made the consumer aware of the problem physically by an uncomfortable indoor air temperature on a hot summer day. And this is possibly after weeks or months of inefficient operation along with the associated increased operating cost. With an unconfirmed but conservative estimate of 70% to 80% of the Air Conditioning systems being operated inefficiently, the amount of wasted energy caused by poor maintenance is staggering. When one considers the cost of that wasted energy on a national level, the figures are nothing short of obscene.

Inventors have in the past sought solutions to the above problems. U.S. Pat. No. 3,544,722 by C. Hartfield et al., issued Dec. 1, 1970 entitled Security System describes a general alarm system for summoning assistance in response to a plurality of mishaps, such as break-in, fire, cold storage failure and so forth in response to sensors.

U.S. Pat. No. 3,441,929 by W. E. Coffer et al issued Apr. 29, 1969 entitled Remote Reporting System describes a general alarm system for reporting burglary, fire, refrigeration failure, etc. It depends on signalling a dedicated receiving station and indicate the different conditions by means of signals generated by motor driven cams.

U.S. Pat. No. 4,028,688 by J. B. Goleman issued Jun. 7, 1977, entitled Refrigeration Unit Air Temperature Detection Alarm System describes a refrigeration alarm system comprising temperature sensors, automatic telephone dialer and recorded message announcer. It also describes the use of a wireless radio connection between freezer compartments and the alarm system.

U.S. Pat. No. 4,146,886 by S. W. Timblin issued Mar. 27, 1979 entitled Freezer Alarm With Extended Life describes a freezer alarm device for locally indicating a freezer malfunction. It has no remote reporting capability.

U.S. Pat. No. 4,278,841 by Regennitter et al., issued Jul. 14, 1981, entitled Multiple Station Temperature Alarm System describes a freezer monitor system with wireless radio connection between the freezer compartments and the alarm system. The invention also describes an automatic telephone dialer combined with a recorded message circuit to deliver a message when the call is answered.

Numerous innovations for an electronic refrigeration and air conditioner monitor and alarm system have been provided in the prior art that are described as follows. Even though these innovations may be suitable for the specific individual purposes to which they address, they differ from the present invention as hereinafter contrasted.

U.S. Pat. No. 5,262,758

System and Method for Monitoring Temperature

Young K. Nam

A temperature monitoring system comprises a sensor for measuring the surrounding temperature, a timer for generating clock data, a controller for reading temperatures at predetermined intervals and storing selected temperature data and corresponding time data in memory, input switches for entering commands and data, a data display, and first and second alarm indicators. The controller operates in predetermined steps to activate the first alarm to indicate a current alarm condition and to activate the second alarm to indicate a past alarm condition. The controller selectively switches the display between normal and alarm modes to show differing time and temperature data depending on the temperature conditions monitored.

U.S. Pat No. 5,136,281

Monitor for remote alarm transmission

James P. Bonaquist

A remote monitoring apparatus comprises a computer program controlled monitor for detecting changes in condition responsive relay switches to generate a data signal identifying the change of switch condition, a report assembler which prepares a report in a preselected format identifying the apparatus location and including the data signal generated, and a modem for automatically transmitting the assembled report to a selected number of remote locations connected with the monitoring site by a telecommunication network. The monitoring apparatus repeatedly accesses the telecommunication network until a successful communication has been transmitted to each remote location. The apparatus also senses the loss of a continuous, primary power source and includes a back-up power supply. The program limits the number of unsuccessful attempts which can be made with the back-up power supply and preserves the assembled reports for later transmission when power has been fully restored. In addition, the remote locations to be contacted can be changed as desired, the format of the reports can be adjusted and the normal and alarm conditions of the relay switches can be adjusted as desired to increase the versatility of the monitoring device.

U.S. Pat. No. 5,008,655

Visual alarm device interconnectable to existing monitoring circuitry

Robert A. Schlesinger, Kimuel L. Hill, Hamid S. Ali, and Mark E. Watson

A visual alarm device monitors the condition of a control and indication circuit and gives a distinct visual alarm upon detection of an abnormal condition in the monitored circuit. The device uses the indicator lights of the monitored circuit itself to give the visual alarm. The alarm device interconnects with the monitored circuit locally requiring no new cabling and remains in a passive state until an abnormal condition is detected. When the monitored circuit is rendered inoperative by a thermal overload trip, the alarm device becomes active to flash the indicator lights to provide a distinct visual alarm. Included in the device is a test switch, an appropriate voltage converter, an oscillator, and a power indication light.

U.S. Pat. No. 4,882,564

Remote Temperature Monitoring System

Paul Monroe and James Kurth

A remote temperature sensing and warning system for a temperature controlled vehicle comprising a remote temperature controlled vehicle comprising a remote temperature sensing unit for measuring the temperature in the transport container and transmitting the temperature signal within a repeating time frame through the existing vehicle wiring to a remote receiver; the receiver decoding and converting the signal into a displayable form to continuously display the current temperature of the transport container; the receiver further detecting out of range temperatures and signal transmission errors and providing visual and aural alarms therefrom.

U.S. Pat. No. 4,675,654

Alarm monitoring device

Bobby E. Copeland

An alarm monitoring system which simultaneously provides a bright alarm light and audible alarm upon the occurrence of an abnormal condition in a function being monitored. The alarm light is reduced to a dim illumination upon acknowledging of the alarm condition by the operator and the audible alarm is also deactivated. The dimmed alarm indication reduces detrimental effect of night vision while maintaining notice of an abnormal condition. Upon acknowledging the alarm condition, an electro-mechanical relay having two normally closed contacts and one normally opened contact is energized to redirect current flow to the alarm indicator lamp through a resistor and cause the dimmed illumination of the indicator lamp. A plurality of alarm indicator circuits are connected in parallel and have diodes connected in the circuitry to prevent electrical feedback in the system from causing false alarm indications in the corresponding alarm circuits. A test switch is provided which allows trouble shooting of the apparatus while the system is in normal use or out of use.

U.S. Pat. No. 4,644,478

Monitoring and alarm system for custom applications

Lawrence K. Stephens and Robert B. Hayes

A monitoring and alarm system of general purpose design can be customized for use with many different applications to provide sophisticated alarming and control functions based on logical relationships among several sensed variables. A central processing unit is connected to receive a plurality of inputs from various sensors, the variety and type of which are the choice of the user depending on the specific application to which the monitoring and alarm system is to be connected. The central processing unit is programmed to provide the user with an interactive display to first define the variables in the application and the states and/or limits of the variables. This action defines a logical group. Next, the user enters the alarm/action functions to be performed on the condition that all the conditions in the logical group are true. Once this interactive process has been completed, the central processing unit performs the alarm and control functions specified by the user.

U.S. Pat. No. 4,612,775

Refrigeration monitor and alarm system

Michael A. Branz and Paul F. Renuad

A refrigerant monitor and alarm includes a sensor positioned to detect the level of liquid state refrigerant in the system and provide an electrical output signal therefrom, a digital display for displaying the refrigerant level, a circuit coupling the digital display to the sensor for actuating the digital display, and a heat reclaim system lockout circuit coupled to the sensor. In a preferred embodiment, the level display is a bar-graph LED-type display incorporated on a control panel also including a refrigerant level alarm and other parameter alarms.

U.S. Pat. No. 4,612,537

Alarm system for monitoring the temperature of a liquid contained in a reservoir Andre Maltais and Andre Nadeau An alarm system and method for monitoring the temperature of a liquid contained in a reservoir. The system comprises a temperature sensing probe for sensing the temperature of the liquid. A sensing circuit is associated with the probe to generate a temperature indicating signal representative of the liquid temperature. A calibration circuit is provided for calibrating the temperature signal relative to a reference signal. Converter means is provided to convert the calibrated temperature signal to a binary signal indicative of sensed temperatures of the liquid whereby to feed comparator circuits having preset limit detectors to initiate an alarm signal when the temperature signal exceeds a predetermined value. The comparator circuits also feed a display device to indicate the temperature of the liquid.

U.S. Pat. No. 4,588,987

Display system for monitoring and alarm system

Lawrence K. Stephens

A display system is provided for a monitoring and alarm system. The monitoring and alarm system includes a central processing unit and a plurality of sensors polled by the central processing unit. A display which is part of the central processing unit is used to prompt user inputs to group a plurality of the sensed variables and the states and limits of each of the variables in a group. The display system is employed by the user to generate a schematic display of the system or environment being monitored. In the process of generating the schematic display, the user links alarm areas on the schematic display with a group or single variable defined by the user. In addition, the user links message areas on the schematic display with user defined messages to be displayed in the event all the conditions defined by the states and limits of variables in a group are true. After each schematic has been generated, it is stored together with the data defining the linked areas of the display. A stored schematic display may then be invoked, and once invoked, messages and status conditions are displayed in response to the sensed conditions of groups of variables sensed by said monitoring and alarm system.

U.S. Pat. No. 4,583,682

Air conditioning monitoring device

Orlando Hernandez

An electric device for monitoring the usage of equipment that is being shared by one or more entities or individuals during a predetermined schedule and that needs to be made available to any one of these entities or individuals outside that schedule. The device includes timing means programmable for any schedule and capable of activating complementary relays, one of them a normally open and the other one a normally closed. The contacts of one of these relays being connected to a suitable point in the equipment being shared so that its operation may be interrupted or turned on. A plurality of second relay means, one associated with each one of the entities, are also connected to that point in the equipment so that each entity may be able to connect the equipment. Also, there is an elapsed time meter associated with each one of those second relay means so that the time that the equipment is used, outside the predetermined schedule can be tracked.

U.S. Pat. No. 4,553,400

Refrigeration monitor and alarm system

Michael A. Branz

A refrigerant monitor and alarm includes a sensor positioned to detect the level of liquid state refrigerant in the system and provide an electrical output signal therefrom, a digital display for displaying the refrigerant level, and a circuit coupling the digital display to the sensor for actuating the digital display. In a preferred embodiment, the level display is a bar-graph LED-type display incorporated on a control panel also including a refrigerant level alarm and other parameter alarms.

U.S. Pat. No. 4,482,785

Refrigeration monitor system with remote signalling of alarm indications

Christopher D. Finnegan and Arthur J. Geiss

A refrigeration monitor system for monitoring an unattended freezer installation having a number of freezer compartments containing perishable products. The system comprises a network of temperature sensors located in the freezer compartments and connected to a common control which is connected to one or more telephone lines. The common control is capable of dialling in sequence any one of a group of selected alarm numbers. The person answering the alarm call receives a recorded message and must return a preselected answer code that is received by the system, and which stops the system from sending more alarm calls. The system continues to dial alarm numbers until it receives a satisfactory answer code. As a further safety measure the system, upon initiating an alarm, sets an alarm status indicator that must be manually reset within a preset time by the person attending to the freezer installation in response to the alarm, or else a new alarm sequence is automatically initiated.

U.S. Pat. No. 4,384,282

Device for Indicating a Freezing Temperature in a Selected Location

Everett G. Dennison, Jr.

The disclosed device comprises a pair of electrical conductors positioned in an elongated flexible insulating member and enclosed in an elongated tubular member which is filled with water or an aqueous solution having a known freezing temperature. The tubular member is sealed at its ends with the electrical conductors in their insulating member extending outwardly of one of the sealed ends and is connected with an alarm actuating circuit. A portion of the insulating member is removed from one of the pair of electrical conductors adjacent one end of the same within the tubular member and a portion of the insulating member is removed from the other one of the pair of electrical conductors adjacent the opposite end thereof so that an electrical circuit is completed through the water or aqueous solution in the elongated tubular member and interrupted when the water or aqueous solution freezes.

U.S. Pat. No. 4,256,258

Temperature monitor and alarm system

George W. Sekiya

The disclosed temperature monitoring and alarm circuit includes a temperature responsive switch which opens when water temperature exceeds a predetermined point. When the switch opens, a relay is de-energized, thereby activating a latch which activates a visual alarm and closes off a solenoid operated valve on the monitored water source until the over temperature condition is corrected and the circuit is reset.

U.S. Pat. No. 4,024,495

Remote Temperature Change Warning System

Frank J. O'Brien

The disclosed remote temperature change warning system comprises a temperature sensing circuit located in the refrigeration compartment of the refrigeration vehicle and a detection circuit located on the vehicle remote from the temperature sensing circuit and having means for indicating to the vehicle operator the temperature condition in the refrigeration compartment, the output of the temperature sensing circuit and the input of the remote detection circuit being electrically connected through the existing electrical wiring of the refrigeration vehicle.

U.S. Pat No. 3,753,259

Cooler and Freezer Failure Warning System

Raymond L. Donovan

The disclosed cooler and freezer failure warning System includes a source of a rectified, pulsating, supply signal, a source of a lower regulated signal supplied by the supply signal source, a temperature sensor installed in a selected location a food case and responsively variable in resistance according to its sensed temperature, means responsive to the sensor resistance for producing a switch signal a predetermined overtemperature condition, means responsive to the switch signal for producing a delayed switch signal, a temperature alarm device, and an alarm switch responsive to the delayed switch signal for applying the supply signal to energize the temperature alarm device. The warning system further includes fail-safe provisions for producing an alarm in the event of sensor failure. A power failure alarm device responsive to a loss of the regulated signal can also be included in the warning system.

U.S. Pat. No. 2,994,858

System for Signalling Failure of Refrigeration Devices

William E. Coffer

The disclosed signal system provides warning signals when dangerously high temperature conditions exist in any of a group of cold storage cabinets. This system is a high temperature detection and alarm system for a group of refrigeration units. This system comprises a sensing circuit including a plurality of normally open thermostatic switches each disposed within one of a group of refrigeration units and is adapted to close when the temperature in any of the units exceeds a predetermined maximum temperature. Several signal devices are arranged in series with these thermostatic switches and are adapted to emit a warning signal when the switch in series with it is closed.

Johnson Controls recently manufactured a device which has an optical sensor to view bubbles or refrigerant conditions in the lines by means of a sight glass. A sight glass is a fitting equipped with a transparent window, usually at both the top and bottom of the fitting, to allow the service persons to actually view the condition of the refrigerant. The optical sensing device would only be instrumental in detecting refrigerant related problems on systems so equipped.

Paragon Electric Company, Inc. of Two Rivers, Wis. manufactures a device which also addresses the same preventive maintenance concerns. This device performs its function by analyzing the current draw on large, commercial systems and correlates that information with a variety of possible system problems. Its sole application is with very large, commercial air-conditioning and refrigeration systems.

Numerous innovations for an electronic refrigeration and air conditioner monitor and alarm system have been provided in the prior art that are adapted to be used. Even though these innovations may be suitable for the specific individual purposes which they address, they would not be suitable for the purposes of the present invention as heretofore described.

SUMMARY OF THE INVENTION

Most HVAC service personnel draw on experience and a variety of acceptable methods when servicing equipment in the field. One of those methods is to measure the temperature on the suction (return) line of a given system for some indication of the possible problem. Most just resort to "feeling" the suction line for a condition of too warm or too cold a temperature. Ideally, the suction line of a properly operating system should "sweat". The term "sweating" refers to the condition of condensation of moisture from air on a cold surface, the suction line.

As was shown in the Description of the Background Art, the operating efficiency of Air Conditioning and Refrigeration systems decreases dramatically with even a minimal lack of system maintenance. As the efficiency (or equivalent EER rating) of a system decreases, so does the capacity of the system decrease. Regardless of the reasons associated with this lack of efficient operation, the operating cost associated with its operation can skyrocket.

It is not arguable that an inefficiently operating air-conditioning system costs a great deal more to operate than one operating with proper maintenance; neither is it arguable that correcting the problem reduces energy consumption and operational cost. Residential and Commercial consumers can benefit directly by lower monthly cooling bills and by getting a longer, useful life from their air-conditioning and refrigeration appliances. The utility companies load management programs can also benefit by lowering their peak load demands. If the majority of Air Conditioning systems being used at the peak load times were operating even close to their efficient levels, the electrical demand can do nothing but decrease. It should also be evident that any energy savings, however minuscule, when multiplied by the large number of units operating inefficiently today in the U.S. can be astounding.

Our current innovation tries to address the problem of preventive maintenance, or lack thereof, on the massive amounts of Air Conditioning and Refrigeration systems in use today. The approach taken is to give the consumer a reliable and affordable means of alerting them to system maintenance problems or malfunctions when it starts to effect the performance of their Air Conditioning or Refrigeration equipment. The means by which this is accomplished is by using sophisticated electronic circuitry to monitor the system's suction line temperatures close to the evaporator coil for variances indicating that the Air-Conditioning or refrigeration system is not operating within its established parameters.

The operating suction pressure (or temperature) of a refrigeration system, be it an Air-Conditioning unit (High Temperature), refrigerator (Medium Temperature), or freezer cabinet (Low Temperature), varies over a range of pressures depending on the heat load on the evaporator for a given system. In turn, because the heat load on the evaporator varies with the amount of air or liquid and/or the temperature of the air or liquid entering the evaporator, it is not possible to establish definite operating suction pressures or temperatures. Therefore, the operating suction pressure of a refrigeration system has no significant value unless it is unusually high or low. And this is precisely the condition the Electronic Refrigeration and Air Conditioner Monitor and Alarm System is designed to look for.

Normally, suction temperature will operate in the range of 35° F. to 65° F., the boiling point of the refrigerant in the high temperature range, −10° F. to −5° F. in the medium temperature range, and −25° F. to −5° F. in the low temperature range. Suction temperature equivalents much LOWER than these ranges indicate that the gas is not returning to the compressor as fast as the compressor is handling the gas. In the case of too HIGH a suction temperature, the compressor is not handling the gas as fast as it is being returned from the evaporator.

With emphasis on Air-Conditioning systems, all high evaporator temperature applications operate off established ARI standards which establish a proper operating temperature range on the suction line at approximately 35° F. to 65° F. Our research and testing has determined that an operating temperature window of approximately 31° F. to 57° F. works best for most Air-Conditioning applications. This specification holds true for all other high evaporator temperature applications as well, including Reciprocating, Rotary or Scroll compressor types and expansion valve or capillary refrigerant metering devices. This covers the majority of systems in operation today for the purposes of Air-Conditioning. This theory will not apply to Centrifugal, Screw or Absorption compressor types which are utilized in some larger, industrial facilities.

The present invention, as it currently stands, will also function on both automotive and refrigerated semi-trailers applications with minor modifications to the power supply. These systems are also considered High Evaporator Temperature systems as well. One would need only to connect the negative ground from the automotive system to a circuit ground connector of the present invention. Likewise, the hot side or power side of the compressor should be connected to the input on the Voltage Regulator of the present invention. Power for the device would be derived from the automotive system's compressor so that the invention would be powered only when power is applied to the compressor.

Though it is not possible to establish exacting temperatures within an Air-Conditioning system for the wide array of variables, it is possible to establish trip points at both the high and low end of the spectrum, with respect to suction line temperature variances. That is the approach of the current innovation, to monitor this temperature range and alert to those instances in which the system is operating outside those parameters indicating inefficient or abnormal operation of the Air-Conditioning or refrigeration system.

Although the electronic schematic diagram of the device (FIG. 4) will provide exacting aspects of the product's electronic design as it stands, a more comprehensive circuit description follows. All printed circuit board references are labeled in parenthesis and are made with reference to the Electronic Refrigeration and Air Conditioner Monitor and Alarm System Electronic Schematic Diagram of FIG. 4. Further references are made from the Electronic Refrigeration and Air Conditioner Monitor and Alarm System Diagram of FIG. 1, and the Installation Diagram of FIG. 2.

The Electronic Refrigeration and Air Conditioner Monitor and Alarm System is a compact, solid state, device that is designed to be attached to either existing ductwork or mounted on the bulkhead in a standard two-gang electrical box. The sensing probe cable length is approximately 8 feet in length to allow mounting flexibility in a variety of locations around an existing furnace for residential applications or within the Air Handler on commercial applications. The Electronic Refrigeration and Air Conditioner Monitor and Alarm System is free of any required adjustments since the internal temperature trip points are set with precision resistors.

The Electronic Refrigeration and Air Conditioner Monitor and Alarm System derives its power from the 24VAC already present in the systems thermostat for control purposes. Since the device is connected directly to the "Y" and "C" connections in an existing system (please refer to the Installation Diagram of FIG. 2), the unit is only powered and active when the system is activated for cooling. This has the advantage of automatic seasonal operation of the device. Once powered, the device rectifies the AC voltage (BR-1) and regulates it to a low +5VDC potential (VR-1) which powers the entire Electronic Refrigeration and Air Conditioner Monitor and Alarm System. A red, front panel LED (LED-1) indicates that power is present within the system and that it is active.

The suction line temperature is sensed by a surface mounted, thermistor probe assembly (RTD-1) and the analog temperature information is converted to a digital state by IC-1, a quad voltage comparator integrated circuit and transistor Q-1. The quad comparator (IC-1) is configured as a window comparator with its temperature range set by precision resistors R1 through R4. This equates to an operating temperature range of approximately 31° F. to 57° F., the proper operating range of the suction line. With a logic "0" or low on the collector of transistor Q-1, the Air Conditioning system's suction line is within its normal, efficient operating temperature range and the device is in its STANDBY mode of operation.

When the probe senses a temperature outside the established normal range, the collector of transistor Q-1 goes to a logic "1" or high and a delay timer built around half of a dual timer integrated circuit (IC-4) is initiated. The duration of this delay timer is set for approximately 15 minutes to allow for system stabilization and is set by resistor R11 and capacitor C5. While the timer is activated, a front panel TEST LED flashes to indicate that the system has sensed an out of range temperature and is in a delay mode for stabilization of the system. This normally occurs during the first activation of the Air Conditioning system or at the beginning of a cycle. The other half of the dual timer I.C. (IC-4) supplies the clocked flasher pulse to the TEST LED. If the suction line temperature remains outside its established normal range after the 15 minute stabilization delay, the D flip flop integrated circuit (IC-5) is clocked and the Silicon Controlled Rectifier (SCR-1) is biased into conduction. This allows current to flow through both the front panel SERVICE LED (LED-3) to provide a visual alert and the piezo element (PZ-1) to provide an audible alert to a problem. If after the 15 minute stabilization delay, a temperature inside the established normal range is sensed, the system is returned to its STANDBY mode of operation.

Integrated circuits IC-2 (quad 2 input NAND) and IC-3 (Hex inverter) and other supportive electronic components provide the necessary logic switching and signal conditioning required in this circuit's design approach.

Systems embodying the present invention include a sensor positioned to detect the temperature level in the system and provide an electrical output signal therefrom, a digital display for displaying the temperature level, circuit means coupling the digital display to the sensor for actuating the digital display, and a heat reclaim system lockout that is activated upon detection of a preselected low temperature level. In one preferred embodiment, a level display may be a bar-graph LED-type display incorporated on a control panel also including a temperature level alarm and other parameter alarms.

Such a system thereby provides a continuous display to maintenance personnel of the temperature level so preventive maintenance can be achieved before an alarm condition exists as well as the other alarm indications all at a convenient, centrally located display panel, as well as preventing the heat reclaim system from exacerbating an already undesirable high or low temperature level condition.

It is therefore an object of the present invention to provide an alarm system capable of monitoring the temperature of a liquid contained within a refrigerated reservoir and providing a continuous display thereof, and initiating an alarm when the temperature exceeds predetermined set temperature limits.

Another object of the present invention is to provide a method of monitoring the temperature of a liquid contained in a refrigerated reservoir and to initiate alarms when the temperature exceeds preset temperature limits.

Another object of the present invention is to provide an alarm system also capable of monitoring various devices associated with a refrigerating reservoir containing a liquid therein.

Yet another object of the present invention is to provide a system whose physical construction may be based on readily available hardware components, that are relatively simple in operation, are very reliable and are relatively inexpensive and have moderate power drain.

According to the above objects and features, from a broad aspect, the present invention provides an alarm system and method for monitoring the temperature of a liquid contained in a reservoir. The system comprises a temperature sensing probe secured to the reservoir for sensing the temperature of the liquid and connected to an input of the system. A sensing circuit is associated with the probe to generate a temperature indicating signal representative of the liquid temperature. A calibration circuit is provided for calibrating the temperature signal relative to a reference signal. Converter means is provided to convert the calibrated temperature signal to a binary signal indicative of sensed temperatures of the liquid whereby to feed comparator circuits having preset limit detectors to initiate an alarm signal, to an alarm circuit, when the temperature signal exceeds a predetermined value. The comparator circuits also feed a display device to indicate the temperature of the liquid.

Further objects of the invention will be brought out in the following part of the specification, wherein detailed description is for the purpose of fully disclosing the invention without placing limitations thereon.

It is therefore a primary object of the present invention to provide a refrigeration monitor system that is fail safe to a high degree without undue complexity.

It is another important object of the invention to provide a refrigeration monitor system that is capable of rendering a high degree of utility by means of mutually cooperating features.

It is another important object of the invention to provide an electronic refrigeration and air conditioner monitor and alarm system that is capable of rendering a high degree of utility without undue complexity as it relates to its physical construction.

It is still another object of the invention to provide an electronic refrigeration and air conditioner monitor and alarm system that is capable of rendering a high degree of flexibility and utility without undue complexity or cost.

It is still another object of the invention to provide an electronic refrigeration and air conditioner monitor and alarm system that is capable of rendering a high degree of flexibility and utility without the need for excessive power drain.

Other objects and advantages of the invention will become clear in the course of the following description.

The present invention is directed to a reliable alarm circuit for monitoring a condition such as water temperature and providing an alarm if the monitored condition departs from a predetermined range. The preferred embodiment of the invention includes an audio alarm, a visual alarm, as well as means for shutting off water flow as long as either alarm is activated.

According to this invention, an electronic refrigeration and air conditioner monitor and alarm system circuit is provided with a temperature sensor which provides a signal when water temperature is within a selected temperature range. An alarm such as an audio or visual alarm, or both, is controlled by switching means and latching means. The switching means is responsive to the sensor and acts to disable the alarm in response to the sensor signal. The latching means acts to maintain the alarm in the activated state after a momentary interruption of the sensor signal.

Preferred embodiments of this invention provide a visual alarm which cannot be reset until the out of range temperature condition is corrected, an audio alarm which can be reset at any time, and a solenoid valve for shutting off water flow whenever the visual alarm is activated.

The alarm circuit of this invention is simple, relatively inexpensive to manufacture, and reliable. It can be designed with a fail safe capability, so that the temperature sensor forms a positive part of the circuit and any attempt to remove the sensor activates the alarm. This invention provides positive protection against excessively hot water: the alarm alerts persons in the area of the danger, and the solenoid valve included in some embodiments eliminates the danger by closing off the water flow.

The invention, together with further objects and attendant advantages, will be best understood by reference to the following detailed description taken in connection with the accompanying drawings.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF DESCRIPTION OF THE DRAWINGS

FIG. 2 depicts a typical installation on a home heating and cooling system. This diagram shows how the invention is connected and mounted onto an average heating and cooling system.

DETAILED DESCRIPTION

Figure 4:
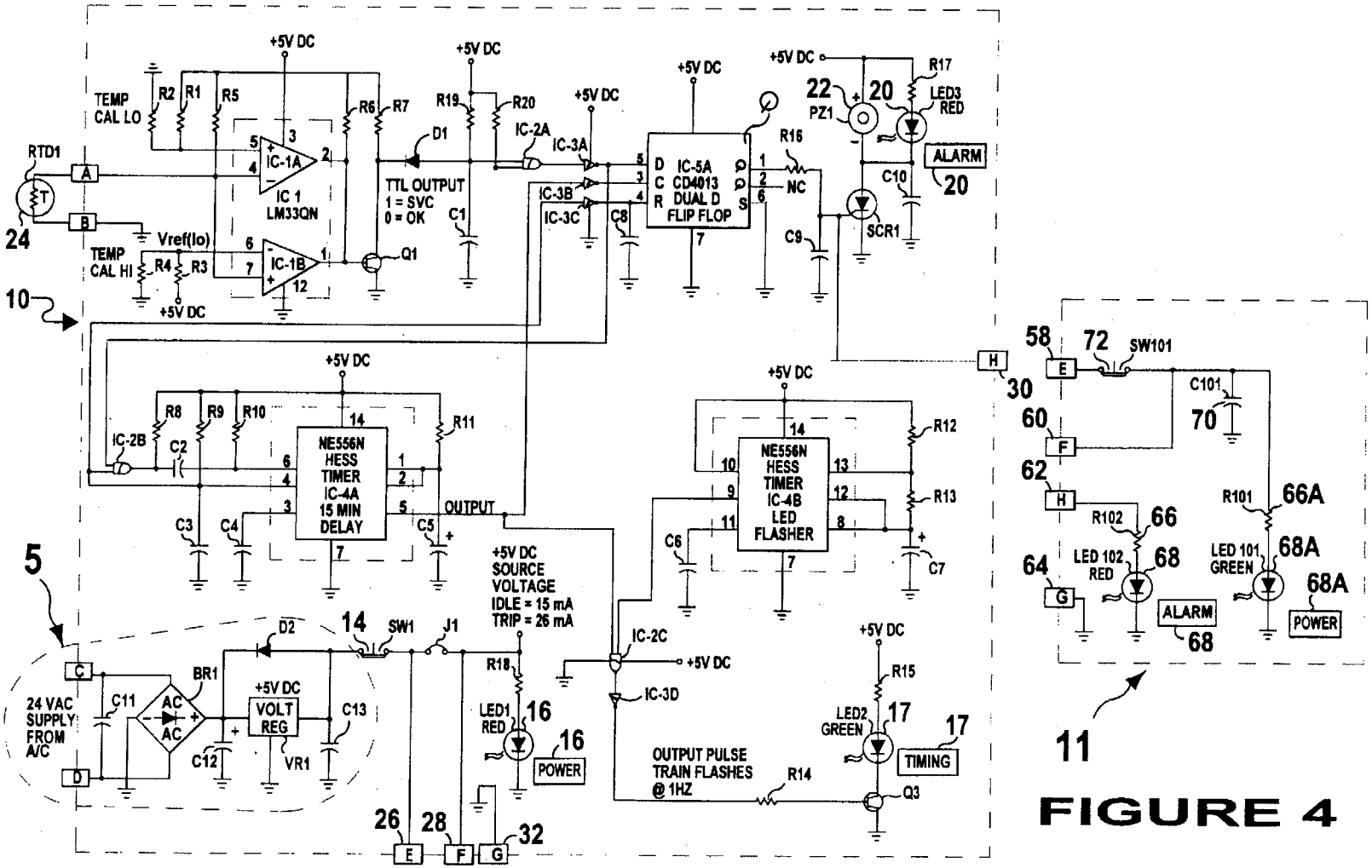
FIG. 4 is a diagrammatic electronic schematic diagram of the electronic air conditioning monitor and alarm system.
Figure 5:
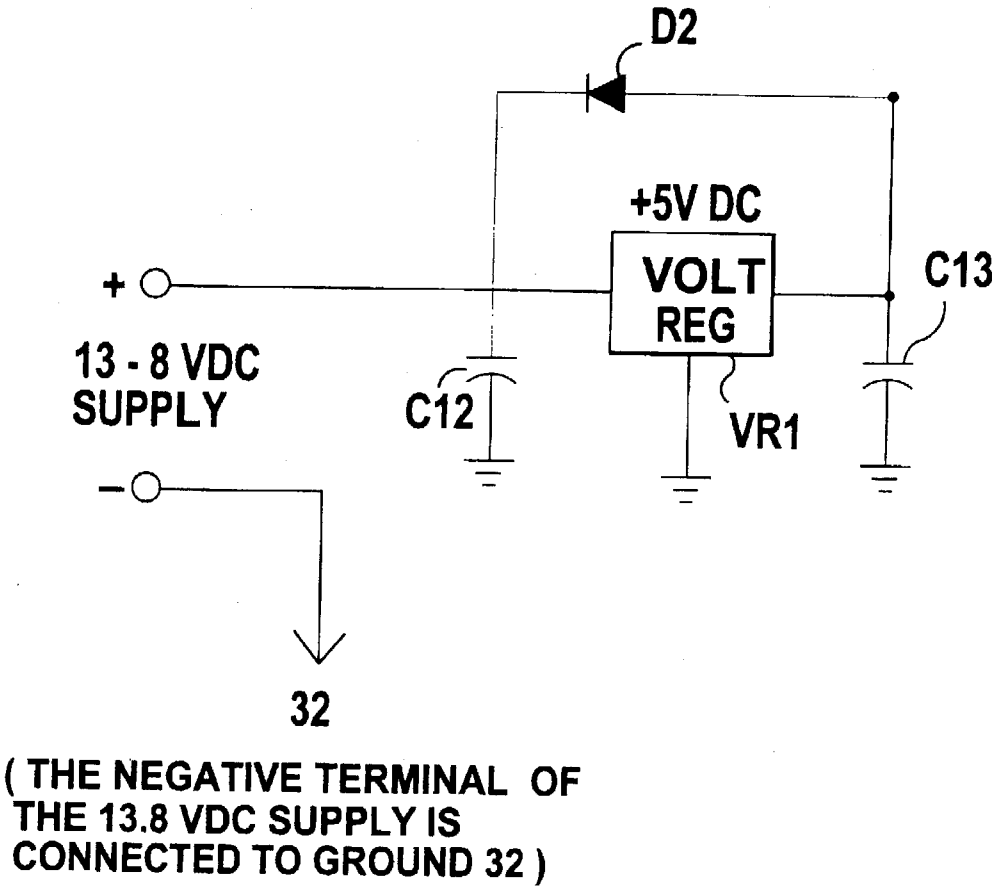
FIG. 5 shows how the circuitry enclosed within the dashed oval portion of FIG. 4 designated by arrow 5 would have to be modified for automotive applications.

5—Portion of the circuit of FIG. 4. As depicted in FIG. 4, the circuitry as shown is that required for air-conditioning applications. FIG. 5 shows how this portion of the circuit would have to be modified for automotive air conditioning applications.

Figure 1:
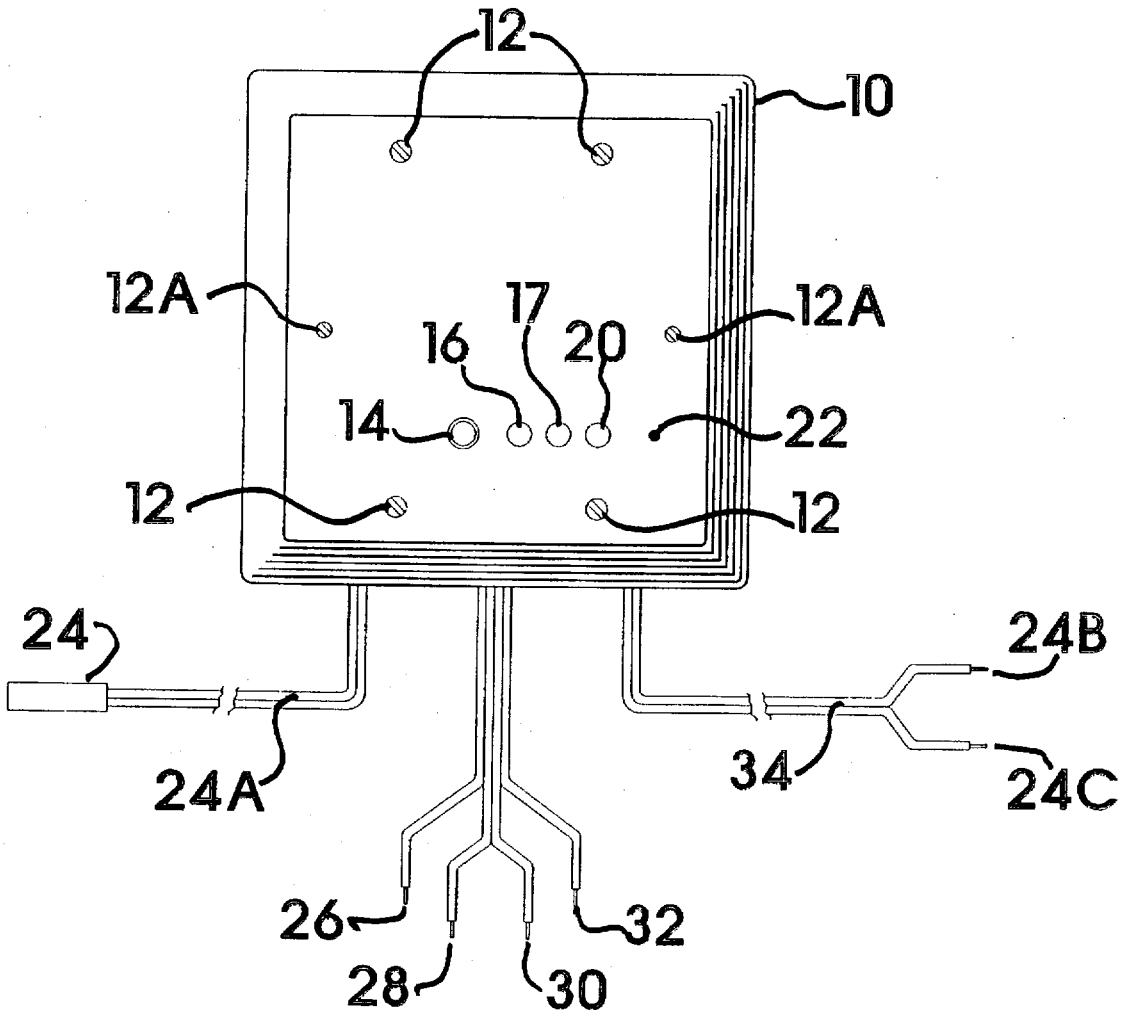
FIG. 1 is a front view of electronic refrigeration and air conditioner monitor and alarm system of the present invention.
Figure 2:
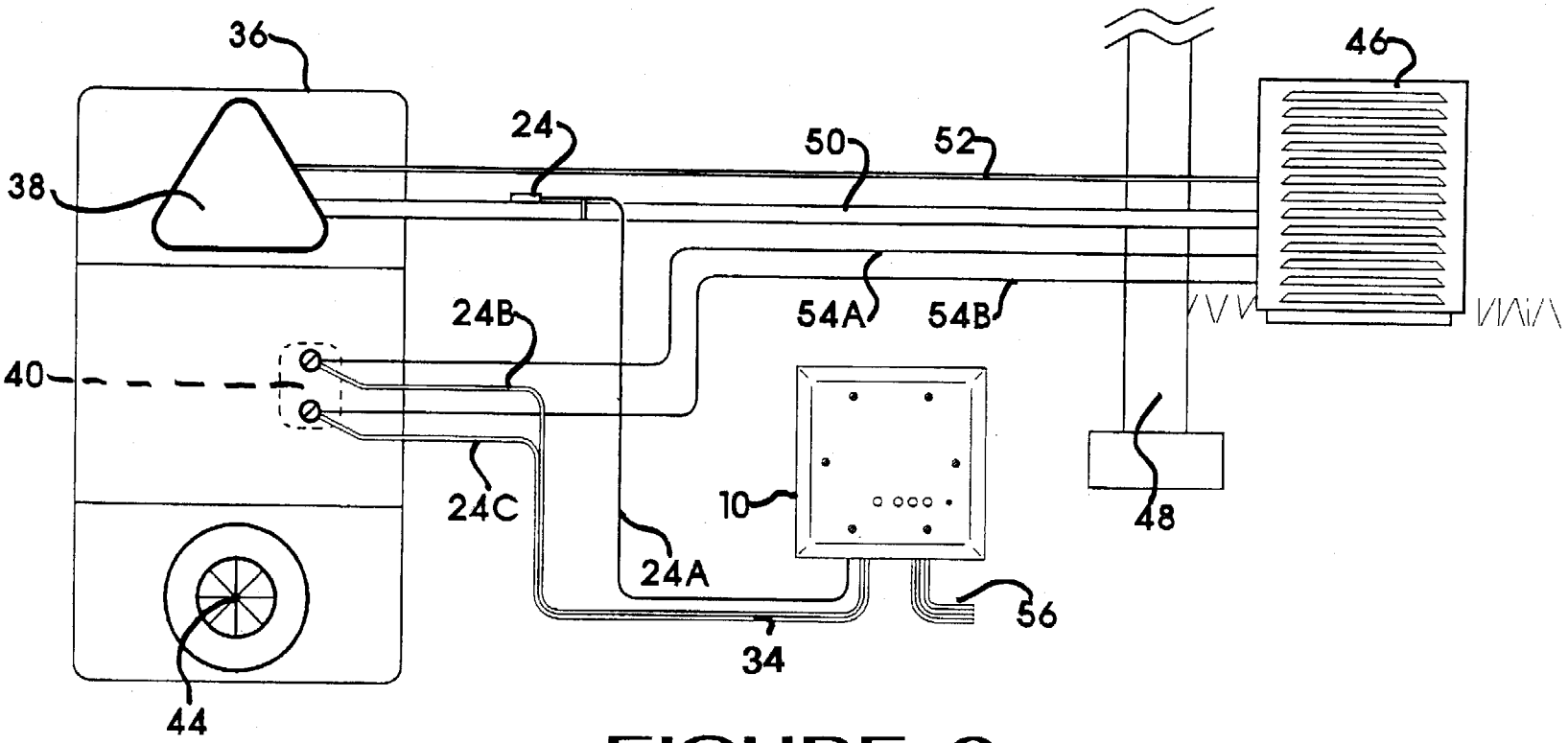
FIG. 2 is a diagrammatic view of an electronic refrigeration and air conditioner monitor and alarm system of the present invention.

10—electronic refrigeration and air conditioner monitor and alarm system (FIGS. 1, 2, 4)

11—optional remote indicator for the electronic refrigeration and air conditioner monitor and alarm system 12—screw holding housing of electronic refrigeration and air conditioner monitor and alarm system 10 together (FIG. 1)

12A—screws holding P.C.B to plate (FIG. 1)

14—on/off/reset switch located on face of housing of electronic refrigeration and air conditioner monitor and alarm system 10 (FIG. 1)

16—power indicator located on face of housing of electronic refrigeration and air conditioner monitor and alarm system 10 (FIG. 1)

17—test or timing indicator located on face of housing of electronic refrigeration and air conditioner monitor and alarm system 10 (FIG. 1)

20—visual alarm located on face of housing of electronic refrigeration and air conditioner monitor and alarm system 10 (FIG. 1)

22—an opening for an audible alarm located on face of housing of electronic refrigeration and air conditioner monitor and alarm system 10 (FIG. 1)

24—sensing probe which is connected to temperature sensing probe line 24A connecting sensing probe at one distal end and to electronic refrigeration and air conditioner monitor and alarm system 10. (FIGS. 1 and 2)

24A—temperature sensing probe line connecting sensing probe 24 at one distal end and to electronic refrigeration and air conditioner monitor and alarm system 10. (FIGS. 1 and 2)

24B—Power hookup connection connected at one distal end to low voltage electrical supply 40 and Y-line conductor line 54A and at the other distal end to electronic refrigeration and air conditioner monitor and alarm system 10. (FIGS. 1 and 2)

24C—Power hookup connection connected at one distal end to low voltage electrical supply 40 and C-line conductor line 54B and at the other distal end to electronic refrigeration and air conditioner monitor and alarm system 10. (FIGS. 1 and 2)

26—red line connected to red remote unit line 58. (FIGS. 1 and 4)

28—white line connected to white remote unit line 60 (FIGS. 1 and 4)

30—green line connected to green remote unit line 62 (FIGS. 1 and 4)

32—black line connected to black remote unit line 64 (FIGS. 1 and 4) (For automotive applications 32 is connected to the automotive system ground.)

34—power hook-up connections comprising both 24B and 24C to be tapped onto an A/C system's thermostat via low voltage electrical supply 40. (FIGS. 1 and 2)

36—furnace comprising evaporating coil 38, low voltage electrical supply 40, and blower fan 44, (FIG. 2)

38—cooling coil (evaporator) connected to cooling coil (evaporator) return line 52 and suction line 50 (FIG. 2)

40—low voltage electrical supply to outside unit 46 connected via C-line conductor 54B and Y-line conductor 54A and also connected to the electronic refrigeration and air conditioner monitor and alarm system 10 via conductors 24B and 24C. (FIG. 2)

44—blower fan which is contained within furnace 36 (FIG. 2)

46—outside unit which is connected to cooling coil (evaporator) return line 52, suction line 50, Y-line 54A, and C-line 54B (FIG. 2)

48—outside wall therethrough passing the following embodiments; cooling coil (evaporator) return line 52, suction line 50, Y-line 54A, and C-line 54B (FIG. 2)

50—suction line connected at one distal end to a cooling coil (evaporator) 38 and at the other distal end to an outside unit 46 (FIG. 2)

52—cooling coil (evaporator) return line connected at one distal end to a cooling coil (evaporator) 38 and at the other distal end to an outside unit 46 (FIG. 2)

54A—Y-line connected at one distal end to a low voltage electrical supply 40 and at the other distal end to an outside unit 46 (FIG. 2)

54B—C-line connected at one distal end to a low voltage electrical supply 40 and at the other distal end to an outside unit 46 (FIG. 2)

56—conductor control cable to remote consisting of red line 26, white line 28, green line 30, and black line 32 connected at one distal end to the electronic refrigeration and air conditioner monitor and alarm system 10 and at the other end to a remote unit (FIG. 2)

Figure 3:
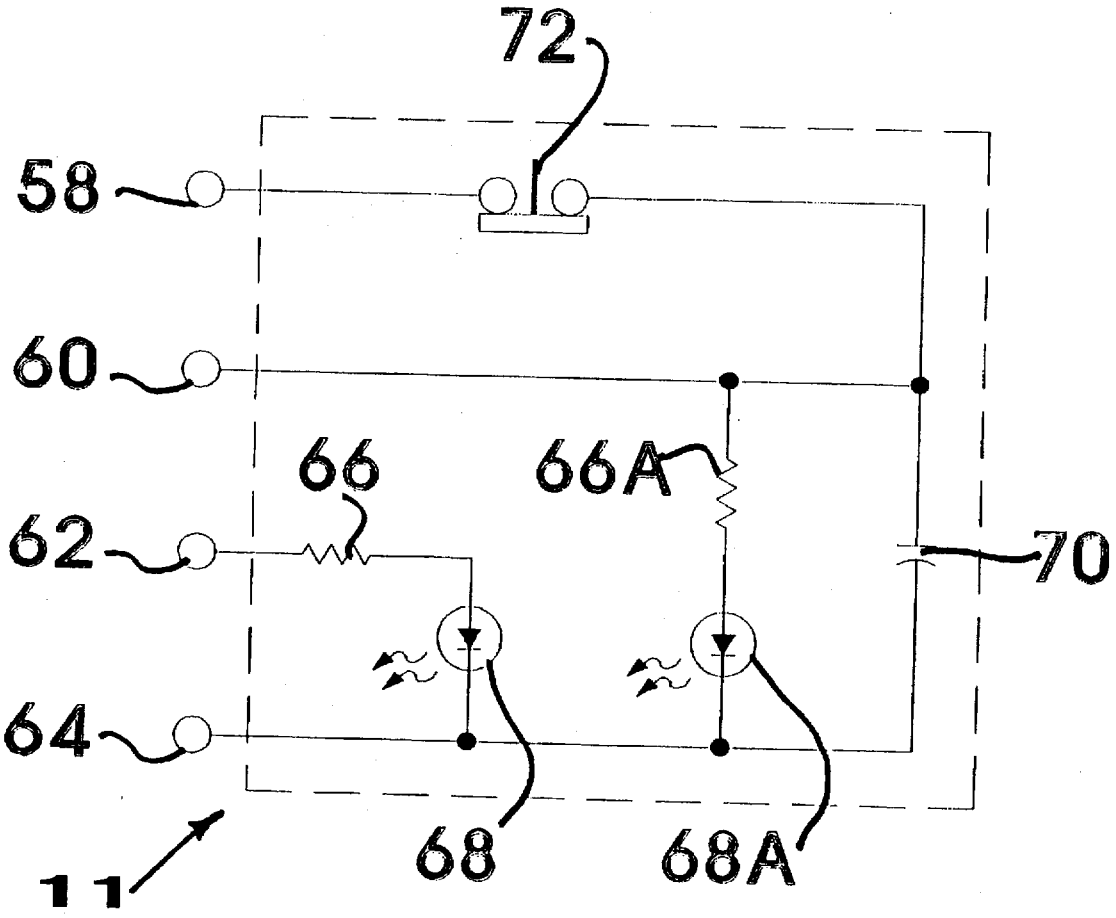
FIG. 3 is a diagrammatic view of a remote unit of the present invention.

58—+5A line is a power line connected to a remote unit (FIG. 3)

60—+5B line is a power line connected to a remote unit (FIG. 3)

62—alarm line is connected to a remote unit and alarm 68 (FIG. 3)

64—Ground is connected to a remote unit (FIG. 3)

66—resistor A is connected between alarm line 62 and alarm indicator 68 (FIG. 3)

66A—resistor B is connected to +5B line 60 and power indicator 68A (FIG. 3)

68—alarm indicator is connected to resistor A 66 and ground 64 (FIG. 3)

68A—Power Indicator is connected to Resistor B 66A and Ground 64 (FIG. 3)

70—capacitor is connected to power/reset 72 within +5A line being a power line connected to a remote unit and ground 64 (FIG. 3)

72—power/reset is connected between +5A line and capacitor 70 and +5B line. (FIG. 3)

DETAILED DESCRIPTION OF THE PREFERRED EMBODIMENT

Firstly, referring to FIG. 1 which is a front view of the electronic refrigeration and air conditioner monitor and alarm system 10 exhibiting the following features: screws 12 holding the housing of the electronic refrigeration and air conditioner monitor and alarm system 10 together, an on/off/reset switch 14 located on the face of the housing of the electronic refrigeration and air conditioner monitor and alarm system 10, a power indicator 16 located on the face of the housing of the electronic refrigeration and air conditioner monitor and alarm system 10, a test indicator 17 located on the face of the housing of the electronic refrigeration and air conditioner monitor and alarm system 10, an opening for an audible alarm 22 located on the face of the housing of the electronic refrigeration and air conditioner monitor and alarm system 10, and a visual alarm 20 located on the face of the housing of the electronic refrigeration and air conditioner monitor and alarm system 10. As seen in FIG. 2, a sensing probe conductor line 24A and a sensing probe 24 are mounted on the evaporator coil suction line 50. The conductor control cable 56 to the remote indicator unit consists of red line 26, white line 28, green line 30, and black line 32 (FIG. 1) connected at one distal end to the electronic refrigeration and air conditioner monitor and alarm system and at the other end to a remote unit, and power hook-up 24B and 24C connections are provided to be tapped onto an A/C systems thermostat.

The electronic refrigeration and air conditioner monitor and alarm system 10 derives its power from 24 VAC available at an air conditioning system's thermostat. This allows the device 10 to cycle with the air conditioning system. The electrical circuit will sense and monitor the temperature of the evaporator coil suction line 50. The sensing device 24 is a thermistor (or other temperature sensitive sensor device) with a negative temperature coefficient. When the air conditioning system turns on, the device 10 is activated and will compare the temperature on the thermistor 24 to the preset range on the device 10 set at approximately 31° and 57° F. If the temperature of the suction lines falls below or rises above the efficient operating temperature range, an approximately 15 minute delay timer is initiated for system stabilization. After the delay, if the temperature remains outside the preset range, an audible 22 and a visual 20 alarm will sound indicating system malfunctioning has occurred and alerting the user that service or maintenance of the air conditioning or refrigeration system is required.

The entire circuit is operated at a low DC potential, preferably about a 5 VDC potential derived from the 24 VAC source available from the existing air conditioning systems thermostat. Since power is derived from the air conditioning system, the device 10 will cycle with the air conditioner. This has the advantage of lower power supply cost as well as automatic system shutdown during off season months when the air conditioning system is idle.

As shown in FIG. 4, the 24 VAC source is routed through bridge rectifier BR1 and is full wave rectified. The rectified DC voltage is filtered by capacitor C12 and is applied to the input of a 5 VDC voltage regulator VR1. The regulated 5VDC is filtered by capacitor C13. A feedback diode D2 protects the voltage regulator from an excessive reverse voltage potential when the power is removed. LED1 (16 in FIG. 1) indicates the presence of 5 volt power to the system by illumination of power indicator 16. The normally closed reset switch SW1 removes power from the circuitry to break the SCR current through the alarm circuit as well as to effect a system reset.

The sensing circuit consists of the sensing probe RTD1 (24 in FIGS. 1 and 2) and sensing probe line 24A having a window (range) comparator built around a National quad comparator integrated circuit or the like. (The sensing probe line refers to the wires from the thermistor temperature sensing probe. The probe is mounted on the equipment to be monitored and the line (wires) from the probe are connected to the monitoring device.) A plurality of comparators are used. The thermistor probe sensor RTD1 forms a lower end of a voltage divider on the sensing input. The low temperature calibration set point is set via the voltage divider comprising R1 and R2. This is also the high voltage reference point to the window comparator. The high temperature calibration set point is set via the voltage divider comprising R3 and R4. This is also the low voltage reference point to the window comparator.

During normal operation, when the sensor temperature is within the specific range, the outputs of comparators IC-1A and IC-1B are held at a logic "HI" through pull-up resistor R6.

This "HI" on the base of Q1 drives the transistor into saturation giving a logic "LOW" to the input of the switching diode D1 holding at least one input to a Schmitt trigger NAND gate IC-2A at a logic "LOW". This logic "LOW" indicates proper system operation of the air conditioning suction line. This is the STANDBY mode of operation. (IC-2 comprises four separate 2 input Schmitt Trigger NAND gates on one I.C. chip. Since only three of the four gates are used, they are designated IC-2A, IC-2B, and IC-2C. IC-2D is not shown, nor is it utilized.)

When the temperature of the thermistor probe 24 (RTD1 in FIG. 4) falls below or rises above the 31–57 degree Fahrenheit range, the comparator IC-1A or IC-1B outputs go to a logic "LOW", respectively. This "LOW" forces transistor Q1 into cutoff changing the collector to a logic "HI". Concurrently, it also forces the cathode of the switching diode D1 to "HI" allowing for a corresponding logic "HI" through pull-up resistor R20, at one input to the Schmitt Trigger NAND gate IC-2A. The other input IC-2A is held at a logic "LO" at power up until the capacitor C1 charges through resistor R19. This delay prevents power-up spikes from falsely triggering the logic control circuitry. The NAND gate IC-2A and inverter IC-3A form a logic AND gate. (IC-3 comprises six separate logic inverter gates on one I.C. chip. Since only four of the six are used, they are designated IC-3A, IC-3B, IC-3C, and IC-3D. IC-3E and IC-3F. are not shown, nor are they utilized.) With both inputs to the aforementioned AND gate at a "HI" potential, the output also goes "HI". This logic "HI" is routed to both the data input of the D flip flop IC-5A as well as to one input on NAND gate IC-2B. The other input of IC-2B is derived from the reset output of a timer usually being fifteen (15) minutes built around one half of a National or Signetics NE556N dual timer integrated circuit or the like. At initial power up of the system, the reset line to the timer is held at a logic "LOW" until capacitor C3 is charged through resistor R9. This delay is set to initiate a reset condition upon first powering up of the system. The initial "LOW" is inverted through inverter IC-3C and applied to the reset input on the D flip-flop IC-5A holding it in its reset condition on powering up of the circuitry. With both inputs to NAND gate IC-2B at a logic "HI" the output goes to logic "LOW". The negative triggering pulse is routed to the delay timer through capacitor C2. AC triggering is necessary since the input can remain at a logic "LOW" level for a period longer than the timing cycle. The delay on the fifteen (15) minute timer IC-4A is set by the RC values of R11 and C5. C4 is on the control input of the timer to prevent false triggering. (IC-4A is half of the dual timer circuit IC-4; i.e., IC-4 comprises two individual timers identified as IC-4A and IC-4B.) The output of the timer is at a logic "HI" for the duration of its cycle. This logic "HI" is routed to a logic AND gate comprising NAND gate IC-2C and inverter IC-3D. The other input to this logic AND is from the Signetics or National NE556N dual timer integrated circuit IC-4B with resistors R12 and R13, and capacitor C7 setting the frequency and duty cycle of the flasher's pulse train. With the logic AND gate enabled, transistor Q3 is switched between cutoff and saturation via the flasher's pulse train causing visual alarm 20 (LED2 in FIG. 4) to flash. The flashing will continue for the duration of the fifteen (15) minute delay.

The logic "HI" output of the fifteen (15) minute delay timer is also routed to an inverter IC-3B. The output of the inverter IC-3B is at a logic "LO" during the timing cycle. Once the timing cycle is completed, and the output of the delay timer goes "LOW", when the corresponding positive going pulse on the output of the inverter IC-3B goes "HI", it clocks the D flip flop IC-5A. This positive going clock pulse passes the input on a data line to the Q output (Referenced as Q in FIG. 4). If the data line to the D flip flop IC-5A is at a logic "HI" at the end of the timing cycle, indicating a malfunctioning system condition, this "HI" is passed to the Q output, triggering a silicon controlled rectifier SCR1 into conduction. (It should be mentioned that the Dual D Flip Flop (IC-5) has two separate D Flip Flop circuits on the chip. Since only one is used, I had referenced it as IC-5A. IC-5B is not shown, nor is it utilized. IC-5 would have comprised both IC-5A and IC-5B.) Once the SCR1 is triggered, it allows current to flow through the audio piezo alarm 22 (PZ1 on FIG. 4) and the service visual alarm 20 (LED3 on FIG. 4). Both the audible alarm PZ1 and the visual alarm LED3 (alarms 22 and 20 respectively) will be active until the reset button SW1 (14 in FIG. 4) is depressed breaking the current flow through SCR1 and resetting the entire sensing and logic circuits. If at the end of the fifteen (15) minute delay, the system has returned to a temperature within the specified temperature range, the system will go to its STANDBY mode until another malfunction is sensed by probe 24 (RTD1 in FIG. 4).

When system reset switch 14 (SW1 on FIG. 4) is depressed and the temperature on the sensor probe RTD1 is still outside the specified temperature range, the fifteen (15) minute delay timer is again actuated and the alarm will again sound if the malfunction continues beyond the fifteen (15) minute delay. If the optional remote indicator 11 is used in the system, the reset switch 72 (SW101 on FIG. 4) on the remote can also be used to accomplish system reset.

The present invention, as it currently stands, will also function on both automotive and refrigerated semi-trailers applications with minor modifications to the power supply. These systems are also considered High Evaporator Temperature systems as well. With reference to FIG. 4, the portion of the circuit enclosed by the dashed oval 5 would have to be modified as shown in FIG. 5 for automotive and refrigerated semi-trailer applications. Thus, the negative ground from the automotive system would be connected to the circuit ground connector 32, Likewise, the hot side or power side of the compressor would be connected to the input on VR1 at the junction of D2, C12, and VR1 (with reference to FIG. 4). Also, components BR1 and C11 should be removed for a DC powered system like those found on automotive applications since they are no longer needed to rectify an AC supply voltage to DC. Power for the device would be derived from the automotive system's compressor so that the invention would be powered only when power is applied to the compressor.

The preferred value for each of the electrical components of FIG. 4 is given in the following table: (Those resistors with a 1% tolerance are those which determine the accuracy of a temperature reading.)

| Component | Part Description | Tolerance or Notes |
|---|---|---|
| BR1 | W04M Bridge Rectifier | |
| C1,C3,C8–C10 | 0.1 μF, capacitor, mylar | |
| C2 | 0.001 μF, capacitor, mylar | |
| C4,C6 | 0.01 μF, capacitor, mylar | |
| C5 | 220 μF, 10 V cap, elect. | |
| C7 | 47 μF, 25 V cap, elect. | |
| C11 | 0.002 μF, capacitor, mylar | |
| C12 | 2200 μF, 50 V cap, elect. | |
| C13 | 0.33 μF, capacitor, mylar | |
| C101 | 0.1 μF, capacitor, mylar | NOTE 1 |
| D1 | 1N4148 Signal diode | |
| D2 | IN4004 Rectifier diode | |
| D2 | IN4004 | |
| IC-1 | LM339AN Quad comparator | |
| IC-2 | CD4093BE Quad NAND, Schmitt Trig | |
| IC-3 | CD4049BE Hex Inverter, Schmitt | |
| IC-4 | NE556N Dual Timer | |
| IC-5 | CD4013BE Dual D flip flop | |
| LED1 | LED, Green, POWER | |
| LED2 | LED, Yellow, TEST | |
| LED3 | LED, Red, ALARM | |
| LED101 | LED, Green, POWER | NOTE 1 |
| LED102 | LED, Red, ALARM | NOTE 1 |
| NC | No Connection | |
| Pz1 | Piezo element | |
| Q1,Q3 | 2N2222 Transistor, NPN | |
| R1,R3,R5 | 33.2K ohm, resistor | 1% |
| R2 | 30.9K ohm, resistor | 1% |
| R4 | 15.0K ohm, resistor | 1% |
| R6–R10,R14 | 10K ohm, resistor | 5% |
| R11 | 2.7M ohm, resistor | 5% |
| R12 | 22K ohm, resistor | 5% |
| R13 | 4.7K ohm, resistor | 5% |
| R15 | 270 ohm, resistor | 5% |
| R16 | 1K ohm, resistor | 5% |
| R17,R18 | 330 ohm, resistor | 5% |
| R19,R20 | 100K ohm, resistor | 5% |
| R101,R102 | 330 ohm, resistor | 5%, NOTE 1 |
| RTD1 | Temperature probe, +/– 0.36 degrees negative temperature coefficient. 31.06K ohms F @ 30° F. 27.31K ohms F @ 35° F. 14.78K ohms F @ 60° F. 10.46K ohms F @ 75° F. | |
| SCR1 | 2N5060 SCR, sensitive gate | |
| SW1 | Power/reset Switch, DPDT, push ON/push OFF | |
| SW101 | Switch, DPDT, push ON/push OFF | NOTE 1 |
| VR1 | MC7805CT Voltage Regulator, +5 V | |

NOTE 1: for use on optional remote indicator.

The labels "POWER", "TIMING", and "ALARM" which appear in FIG. 4 are words which appear on the transparent front panel indicators through which the associated LEDs shine so that the status of these LEDs can be readily ascertained.

Systems embodying the present invention include a sensor positioned to detect the temperature level in the system and provide an electrical output signal therefrom, a digital display for displaying the temperature level, circuit means coupling the digital display to the sensor for actuating the digital display, and a heat reclaim system lockout that is activated upon detection of a preselected low temperature level. In one preferred embodiment, a level display may be a bar-graph LED-type display incorporated on a control panel also including a temperature level alarm and other parameter alarms.

Such a system thereby provides a continuous display to maintenance personnel of the temperature level so preventive maintenance can be achieved before an alarm condition exists as well as the other alarm indications all at a convenient, centrally located display panel, as well as preventing the heat reclaim system from exacerbating an already undesirable high or low temperature level condition.

FIG. 2 is a diagrammatic view of a typical installation of an electronic refrigeration and air conditioning monitor and alarm system 10 exhibiting the following features: temperature sensing probe line 24A connecting sensing probe 24 at one distal end and to the electronic refrigeration and air conditioning monitor and alarm system 10, Y-line conductor 54A connected at one distal end to the low voltage electrical supply 40 and at the other distal end to the outside condenser unit 46, C-line conductor 54B connected at one distal end to the low voltage electrical supply 40 and at the other distal end to the outside condenser unit 46, furnace 36 comprising evaporating coil 38, low voltage electrical supply 40, and blower fan 44; cooling coil (evaporator) 38 connected to cooling coil (evaporator) return line 52 and suction line 50, power line conductor 24B connected at one distal end to the low voltage electrical supply 40 and Y-line conductor 54A and at the other distal end to the electronic refrigeration and air conditioning monitor and alarm system 10, power line conductor 24C connected at one distal end to the low voltage electrical supply 40 and C-line conductor 54B and at the other distal end to the electronic refrigeration and air conditioning monitor and alarm system 10, sensing probe 24 which is connected to temperature sensing probe line 24A connecting sensing probe 24 at one distal end and to the electronic refrigeration and air conditioning monitor and alarm system 10; blower fan 44 which is contained in furnace 36; outside unit 46 which is connected to cooling coil (evaporator) return line 52, suction line 50, Y-line 54A, and C-line 54B; outside wall 48 wherethrough passing the following elements: cooling coil (evaporator) return line 52, suction line 50, Y-line 54A, and C-line 54B; suction line 50 connected at one distal end to a cooling coil (evaporator) 38 and at the other distal end to an outside unit 46; cooling coil (evaporator) 52 return line connected at one distal end to a cooling coil (evaporator) 38 and at the other distal end to the outside unit 46; Y-line 54A connected at one distal end to a low voltage electrical supply 40 and at the other distal end to an outside unit 46; C-line 54B connected at one distal end to a low voltage electrical supply 40 and at the other distal end to an outside unit 46; and conductor control cable 56 connected to a remote indicator unit consisting of red line 26, white line 28, green line 30, and black line 32 connected at one distal end to the electronic refrigeration and air conditioning monitor and alarm system 10 and at the other distal end to a remote indicator unit.

Lastly, referring to FIG. 3 which is a diagrammatic view of a remote indicator unit exhibiting the following features, +5A line 58 which is a power line connected to a remote indicator unit; +5B line 60 which is a power line connected to a remote indicator unit, alarm line 62 which is connected to a remote indicator unit; Ground 64 is connected to the remote indicator unit, resistor 66 which is connected between alarm line 62 and alarm indicator 68; resistor 66A which is connected to +5B line and power LED indicator 68A; alarm LED indicator 68 is connected to resistor 66 and ground 64, capacitor 70 is connected to power/reset switch 72 within +5A line being a power line connected to a remote indicator unit and ground 64; and power/reset 72 is connected between +5A fine and capacitor 70. This remote indicating device is an optional device to extend the visual indicator and reset functions of the invention to a remote location. It is not necessary for basic system operation.

It will be understood that each of the elements described above, or two or more together, may also find a useful application in other types of constructions differing from the type described above.

While the invention has been illustrated and described as embodied in a electronic refrigeration and air conditioner monitor and alarm system, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An electronic refrigeration and air conditioner monitor and alarm system for monitoring and analyzing the temperature of a suction line of an air conditioning or refrigeration system, said monitor and alarm system comprising:

a) a thermistor probe assembly for responding to said temperature of the suction line;

b) a quad voltage comparator integrated circuit having a plurality of resistors, said quad voltage comparator being connected to said thermistor probe assembly for determining when said temperature of said suction line is outside a predetermined range;

c) a lamp for indicating that the system has sensed a temperature that is outside the predetermined range;

d) an alarming means selected from the group consisting of a visual alarm and an audible alarm for notifying a user of the system that the system needs maintenance or repair; and e) a delay timer for actuating said alarming means when the temperature is outside the predetermined range for longer than a predetermined time period.

2. The monitor and alarm system of claim 1, wherein said plurality of resistors is configured to set the operating temperature range of the quad comparator to approximately 31° to 57° Fahrenheit.

3. The monitor and alarm system of claim 1, said system having means for being driven by an A/C voltage source, said system further comprising means for full wave rectifying said A/C voltage source.

4. The monitor and alarm system of claim 3, further comprising means for regulating said rectified voltage to a regulated D/C voltage.

5. The monitor and alarm system of claim 1, further comprising means for being driven by a D/C voltage source.

6. The monitor and alarm system of claim 5, further comprising means for regulating said D/C voltage.

7. A method for monitoring and analyzing the temperature of a suction line of an air conditioning or refrigeration system having a suction line, said method comprising the steps of:

a) measuring the temperature of said suction line;

b) illuminating a lamp whenever the temperature of said suction line falls outside a predetermined temperature range;

c) measuring the duration of time that said temperature of said suction line falls outside said predetermined temperature range;

d) setting an alarm when said duration of time exceeds a predetermined time limit; and e) disabling said alarm when temperature of said suction line falls within said predetermined temperature range.

8. The method of claim 7, wherein the alarm is an audible alarm.

9. The method of claim 7, wherein the alarm is a visual alarm.

* * * * *